United States Patent [19]

Salmon

[11] 4,313,242

[45] Feb. 2, 1982

[54] AUXILLIARY SEED DISCHARGE FOR COTTON GIN ROLL BOX

[76] Inventor: Joe E. Salmon, 2453 Shades Crest Rd., Birmingham, Ala. 35216

[21] Appl. No.: 44,343

[22] Filed: May 30, 1979

[51] Int. Cl.[3] ..... D01B 1/08

[52] U.S. Cl. ..... 19/55 R

[58] Field of Search ..... 19/55 R, 64.5

[56] References Cited

U.S. PATENT DOCUMENTS

| | | | |
|---|---|---|---|
| 26,516 | 12/1859 | Olmstead | 19/55 B |
| 1,341,168 | 5/1920 | Cotton | 19/55 R |
| 2,149,669 | 3/1939 | Cumpston | 19/55 R |
| 2,743,484 | 5/1956 | Raynor | 19/56 |
| 2,834,057 | 5/1958 | Raynor | 19/55 R |
| 3,091,001 | 5/1963 | Pease et al. | 19/55 R |
| 3,135,021 | 6/1964 | Jennings | 19/56 |

*Primary Examiner*—Louis Rimrodt

[57] ABSTRACT

An auxilliary seed discharge means comprising a helicoid conveyor running axially with and laterally through the length of, the roll box of a saw type cotton gin and extending outwardly thereof through circular openings in the roll box heads to seed discharge chutes. Suitable bearings are provided for rotatably journaling outside the roll box. An adequately rotatable tubular casing is provided to enclose the conveyor in some embodiments. The portion of the casing inside the roll box is suitably perforated to receive clean seed therein but the portions extending out to the seed chutes are plain. The tubular casing is separately rotatably journaled outside the roll box heads. For roughly harvested cotton containing excessive foreign matter, modified embodiments are provided in which the perforated casing is omitted and special helicoid conveyors having greater conveying capacity at the discharge end(s) than at the beginning are employed. Methods of construction for special conveyors is disclosed. The conventional gravitional seed discharge common to all saw gins in general use continues to function in the normal manner without interference from the auxilliary discharge provided by this invention. The conveyors can comprise all right hand or all left hand flight, or, have both, arranged to convey the clean seed to right and left from the vertical center of the roll box according to installation requirements or ginner's preference.

26 Claims, 30 Drawing Figures

AUXILLIARY SEED DISCHARGE FOR COTTON GIN ROLL BOX

BACKGROUND OF THE INVENTION

1. Field of the Invention

The present invention relates to saw type cotton gins and the principal objective is to provide means for increasing the capacity by introducing a positive second, or auxiliary seed discharge means longitudinally through the roll box approximately through the axial center thereof. The auxiliary discharge means comprises a helicoid conveyor preferably having both right and left hand flights and arranged to convey clean seed laterally away from the center of the roll box and to discharge them out through both ends and into seed chutes through which they fall into the common seed conveyor beneath the gin(s).

The capacity of gins in general use today, in normal good operating condition, is limited by the amount of clean seed that can "fall" out of the roll box by gravity through the narrow spaces between the saws (about 11/16" center to center) from side to side, and between the ginning and hulling ribs (2½ to 3" from front to back). I have discovered that capacity can be increased in direct proportion to the amount of additional clean seed discharged through the independent auxiliary seed discharge as provided herein.

Under some circumstances it may be desirable to discharge the seed from the conveyor out only one end of the gin. In this case an all right hand or all left hand flighted conveyor and a single seed chute is used. In either case, independent variable speed power sources are recommended.

2. Description of the Prior Art

U.S. Pat. No. 3,091,001 Pease et al. This patent is directed to a "high-capacity" gin in current use and discloses an important feature of means that assist the gin saws in turning the mass comprising the seed roll. It is essential to recognize the fact that any "float" or powered member introduced into the seed roll rotate in the same direction as the seed roll itself, otherwise the added friction will cause the roll to cease turning and the ribs will choke, the gin saws may be damaged and the lint set on fire.

On the negative side, U.S. Pat. No. 3,091,001 discloses no new means for discharging the clean seed which must still "fall out" the old way. Thus, their statement that the work done by the saws is increased by more than 100% is somewhat exaggerated and can be achieved only by providing additional seed discharge means which are in no way disclosed, or even recognized as being desirable. Relying solely on the seed falling out by gravity has proven to be the barrier to significantly higher capacity in gins in current use. The present invention solves this problem by providing a second, or auxiliary seed discharge as disclosed herein.

U.S. Pat. No. 3,135,021 Jennings. This is an inoperable device, due mainly to the friction resulting from the cylinderical housing 17 "fixed" to the gin frame which prevents the free turning of the roll. There is no access to the area where the saws enter the rotary ribs, where chokes occur, especially if the roll rotation is impeded as by housing 17. More important is the failure to provide any means to operate the valve 20 either outside or inside the frame 10. This is a clear violation of Rules Of Practice in failing to illustrate every feature specified in the claims. Under these circumstances this patent cannot be considered an operable or valid disclosure for removing seed from the roll box. Furthermore there is no disclosure of a gravity seed discharge as in convential saw gins. The frame 10 is completely closed at the bottom.

By providing both gravity and positive auxiliary seed discharge means, the ginning art is significantly advanced by my invention as fully disclosed herein.

U.S. Pat. No. 2,743,484 Raynor. This "trash remover" for removing foreign matter from the center of the roll box in no way anticipates the concept of the present invention. By inference, the perforations are too small to admit cotton seed which must fall out between the saws in the conventional way. (Col 4, lines 21–26) Even if seed could enter the perforations they would be sheared by the spiral land of the breaker 56 which "sweeps" the inner surface of the member 50. (Col. 3, lines 6–12) Further, the patent claims "aperforate cylinder rotatably mounted—", but there is no antecedent for "rotatably mounted" any where in the specifications. Neither do the drawings show journal bearings for so mounting the casing, nor do they show any means of driving the casing. FIGS. 3 and 4 show member 50 as fixed to the ends of the roll box. The drawings are also inconsistent; FIG. 1 shows the drive to axle 54 from two different shafts, one of which is saw shaft 14 as in FIG. 3, and an unnumbered shaft in FIG. 1. In either case the rotation of axle 54 is clockwise the same as saw axle 14. How, and in what direction is the tubular member rotated? Another defect reflecting the inadequacy of this Patent is that the drive to breaker axle 54 is from a source to the rear of a line from this axle through the center of the pivot of the gin breast. In this position belt 58 would prevent the opening of the breast which is an essential requirement of gins of the type illustrated. There is no provision for loosening or disengaging belt 58. The gin as illustrated is completely inoperative. It is obvious that this fails in several ways to meet the requirements of the Rules Of Practice for clear disclosure to fully support every element in the claims.

There is no valid anticipation in this patent by itself, or in combination with the previously reviewed patents to suggest the advances in the ginning art clearly illustrated, specified and claimed by me in this application, and only the "hindsight" provided herein teaches the essential final steps and combinations in achieving an important improvement in high capacity ginning by providing a second, or auxilliary clean seed discharge means of this invention.

SUMMARY OF THE INVENTION

An auxiliary clean seed discharge comprising helicoid conveyor used with or without and independently driven, rotatable perforate casing, depending on the type or condition of cotton being ginned is employed to positively remove an additional amount of clean seed and foreign matter laterally out through the end heads of the roll box of an otherwise conventional saw type cotton gin. Several configurations of conveyors are provided, each interchangeable with the others for a specific gin, thus permitting the ginner to select the type best suited to the type of cotton being ginned, or to the condition of the cotton, which varies with weather, harvesting methods, etc. The auxiliary seed discharge located in the approximate axial center of the roll box toward which the clean seed gravitate positively removes a substantial amount of the seed over and above those that fall out through the convential gravity discharge. This allows a much higher through-put of seed cotton with no resulting increase in roll density such as occurs when a conventional gin not so equipped is overfed. By providing separate, and preferably variable speed, positive external drives to the conveyor, and to the casing, when used, the ginner is given a degree of control not previously possible. By locating the power source in a position forward of the auxilliary seed discharge means are also provided to automatically stop rotation of the auxilliary seed discharge upon opening of the gin breast for any reason. These means can also be used to resume rotation if the ginner chooses. While discharge of seed out both end of the roll box is preferred, especially on gins over six feet long, conveyors that discharge at either end are provided.

Specific details, objects and advantages of the invention will become apparent as the following description of the several embodiments of the invention and methods and uses of the invention prceeds.

BRIEF DESCRIPTION OF THE DRAWINGS

Referring to the drawings, the presently preferred embodiments of the invention are illustrated in which:

Referring now to the drawings and particularly to FIGS. 1 to 7 inclusive, I show one embodiment of my invention applied to a brush type saw gin having the conventional gravity seed discharge. The gin is indicated generally by the numeral 10 and comprises a main frame 11, ginning breast 12 and huller breast 13 attached to ginning breast 12. The breasts are movably mounted on the main frame to permit their being moved together from open to closed positions. FIG. 2 shows them in the closed, or ginning position. The roll box, indicated generally by the numeral 29 is defined by end breast heads 25, cove board 78, front wall 79 and ginning ribs 18. Saw cylinder 74 comprises a plurality of spaced saws 15 mounted on shaft 75 journaled in bearings 76 on frame 11 and driven by pulley 77 and belt 94 from motor 95. Seed cotton 80 enters huller breast 13 as indicated by arrow 81. Saws 15 rotate counterclockwise as indicated by arrow 16 and project through roll box 29 and into breast 13 where they pick up seed cotton and pull it into the roll box to form a rotating seed roll. The lint is pulled between ginning ribs 18, leaving the clean seed in roll box 29 from which some fall out through gravity discharge 14, indicated by arrow **14*a*. This embodiment comprises conveyor 19 having both right hand flight 19*a* and left hand flight 19*b* mounted on shaft 30 and enclosed in tubular perforate casing 22 running longitudinally through roll box 29 approximately in the axial center and parallel to saw shaft 75. The flights 19*a* and 19*b* start at the center 19*c* and are both "faired in" tangent to shaft 30 as shown in FIGS. 5 and 6. When rotated, as shown by arrow 48 at appropiate speed, conveying is outward from center in both directions. Shaft 30 project through circular openings 46 and 47 of chute 20 which is rigidly supported by arms 33 affixed to breast heads 25 on each end and is journaled in bearing 31 affixed to the outside of chute 20. Casing 22 comprises a perforate central section 23 for admitting clean seed, and plain end sections 24. Both casing 22 and conveyor 19 extend out of the roll box through circular openings 26 in heads 25. These openings are sized to provide "running clearance" for casing 22 which is supported in bearings 27 fixed by suitable fasteners to the outside of heads 25. Seals 32 fit around casing sections 24 between heads 25 and bearings 27 to prevent escape of fine trash. Conveyor 19 and casing 22 are independently driven at appropiate speeds by pulleys 21 and 28 respectively. The perforate section 23 is coextensive in length with the roll box 29 and plain ends 24 extend outwardly into chutes 20 through openings 46 which are in axial alignment with openings 26 as best seen in FIG. 3. Flexible seals affixed to chute 20 encircle casing ends 24. By supporting chutes 20 rigidly from breast heads 25 they move with the breast when it is "opened", or moved to the inactive position away from the saws 15. I also provide flexible conduits 34 connecting chutes 20 to the main seed conveyor (not shown) beneath the gin(s), where the seed from the auxilliary discharge mingle with the seed from the gravity discharge 14. Chute(s) 20 are located outside the integral drives on the gin to provide clearance thereof. Conduits 34** allow free movement of the chutes with the breast but prevents escape of seed or dust.

Figure 7:
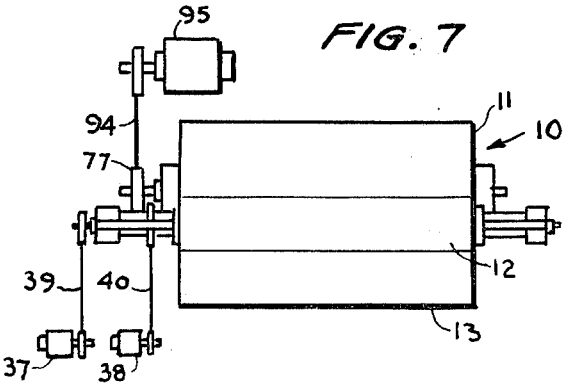
FIG. 7 is a diagramatic plan view of the general arrangement of the gin and the separate external drives to the conveyor and casing and to the saw shaft.

Because of the required forward movement of the breasts, the power source(s) for the conveyor and casing are located forward thereof as shown in FIG. 7. Power sources 37 and 38 for conveyor 19 and casing 22 respectively are preferably D.C. motors or, A.C. motors with variable speed drives, of which there are many from which to choose, to permit appropiate speed adjustments while in operation. Belts 39 and 40 drive pulleys 27 and 28 respectively. When the breast is opened both belts become slack and rotation of conveyor and casing ceases. Conversely, when the breast is closed again to ginning position the belts are tightened and rotation resumes, if power sources 37 and 38 are running.

For added safety I also provide limit switch 41 wired "normally open" mounted on frame 11 adjacent the juncture of frame 11 and breast 12. Bracket 42 is attached on the breast in contacting relationship with the activating arm of the switch. Thus when the breast is opened the electrical control circuit for the motors is automatically opened and the motors also stop. Returning the breast to ginning position will also close the control circuit and restart the motors if the main circuit switch is closed.

Limit switch 41 is included in the control circuit for whatever type motors are used. It is obvious that the motors may be dispensed with and the drives taken from one of the gin shafts, to a counter-shaft in the forward position and back to the pulleys 21 and 28. Even gear drives arranged to drive at appropiate speed and to mesh and unmesh with the movement of the breast may be used. Any such combination acting in response to the breast movement is within the scope of this invention.

Figure 2:
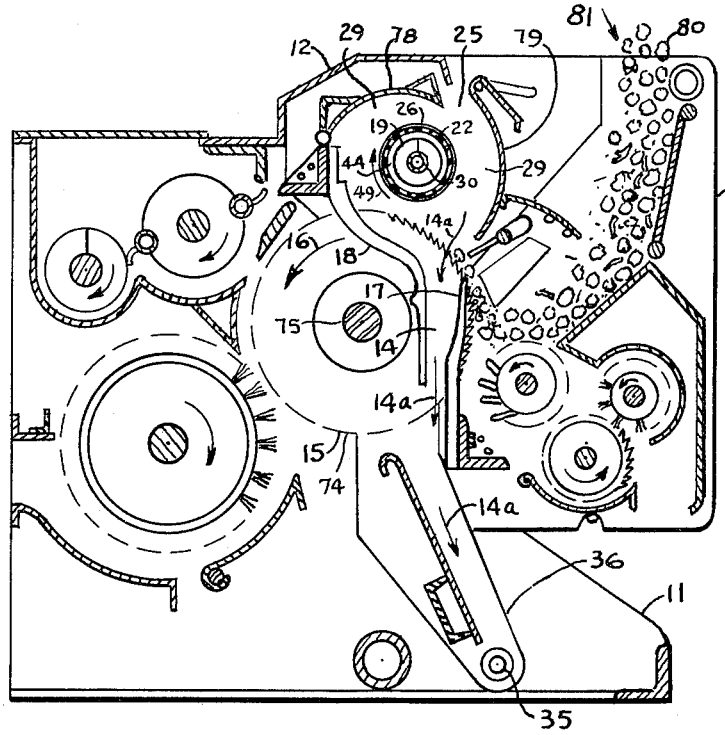
FIG. 2 is a sectional view of the gin taken along lines 2—2 of FIG. 1.
Figure 4:
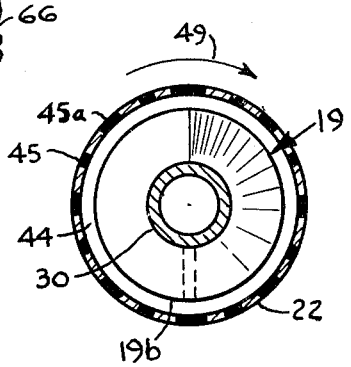
FIG. 4 is an enlarged sectional view taken along lines 4—4 of FIG. 1.

Regardless of the drive means selected it is essential that the casing 22 is positively driven, independently, to rotate in the same direction as the seed roll, as indicated by arrows 49 in FIGS. 2 and 4. Considerable help is thus given the saws in turning the roll, especially when the casing is driven at, or above the speed of the roll when turned by the saws alone.

Figures 1, 22, 25, 26:
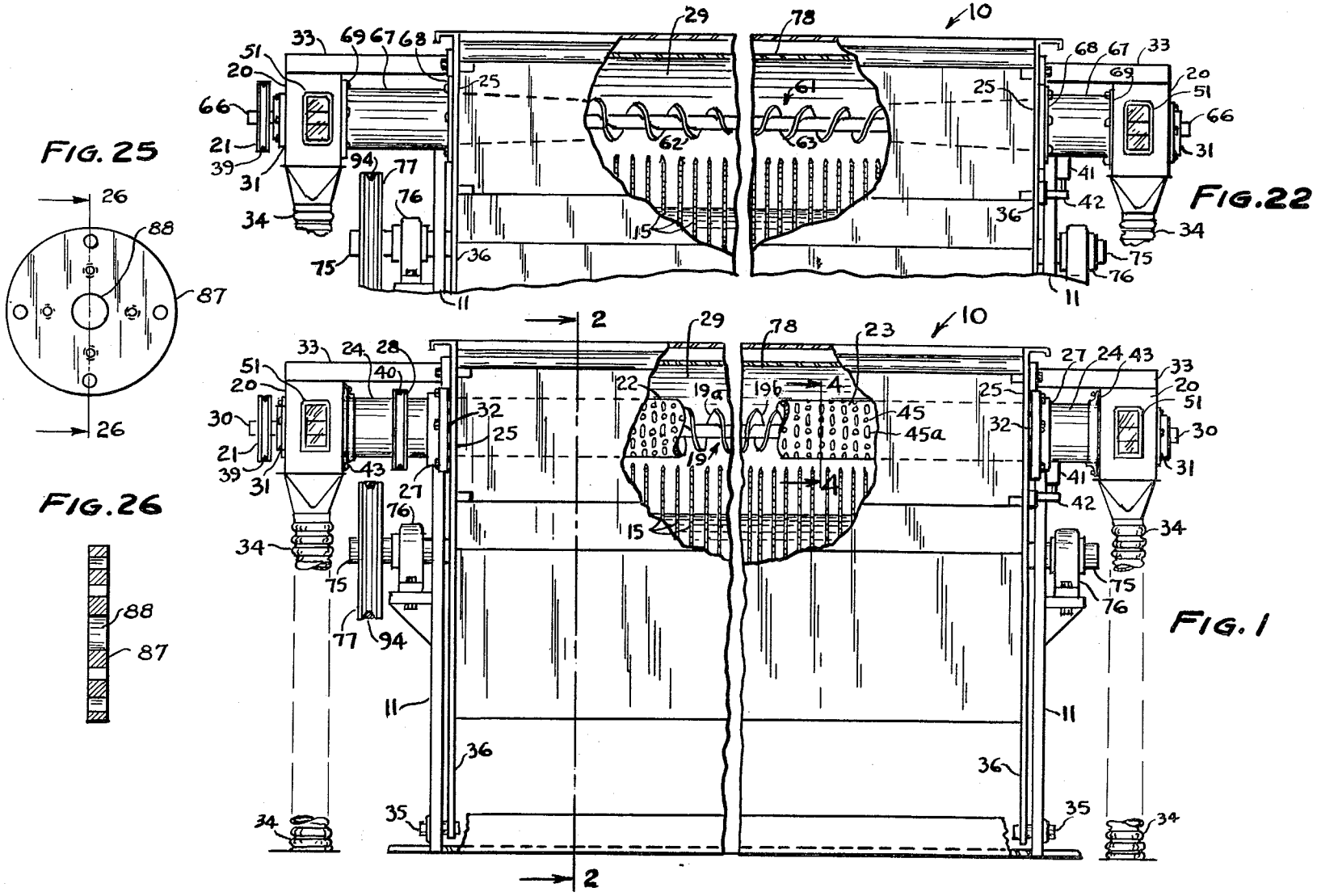
FIG. 1 is a front elevational view of the gin having seed discharge at each end, the view being partly broken away and in section.
FIG. 22 is a fragmental elevational view of another embodiment of the gin in which the rotatable perforate casing is omitted, the view being partly broken away and in section.
FIG. 25 is an end elevational view of the plate used to mount one of the conveyor bearings centrally over the opening in one end of the roll box as shown in FIG. 24.
FIG. 26 is a sectional view taken along lines 26—26 of FIG. 25.
Figure 3:
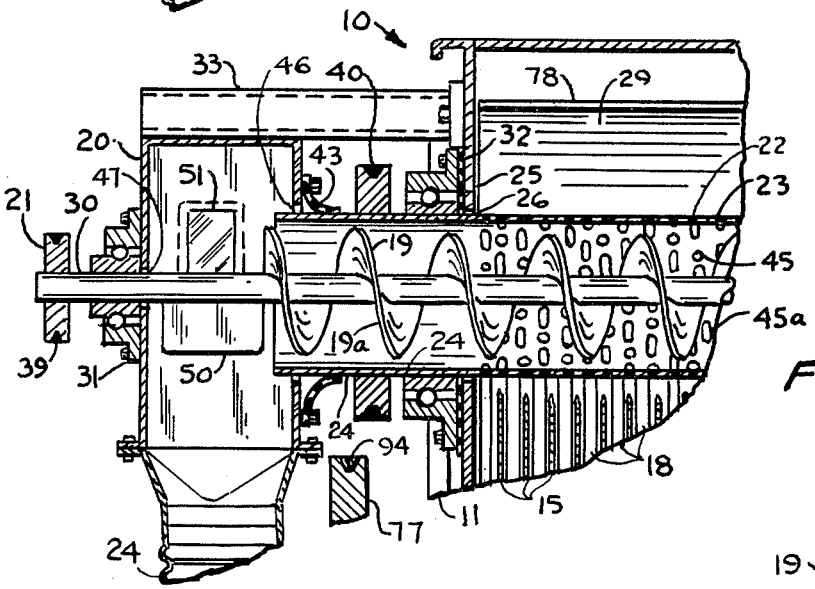
FIG. 3 is a fragmental front elevational sectional detail view of the left end of FIG. 1.
Figure 6:
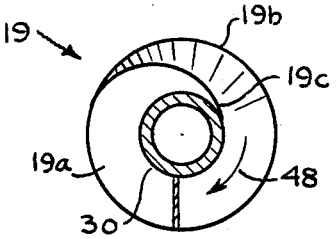
FIG. 6 is a sectional view of the conveyor taken along lines 6—6 of FIG. 5.

The round holes 45 in the section 23 of the casing are preferably $\frac{3}{8}''$ to $\frac{1}{2}''$ diameter arranged in spaced rows from $\frac{1}{2}''$ to $\frac{5}{8}''$ apart longitudinally and $22\frac{1}{2}$ degrees circumferentially. I find it helpful to slot a substantial number of the holes circumferentially to about $\frac{3}{4}''$. For example: I may slot every other hole in each row, alternating each row so there is a round hole between the slotted holes in each direction as shown in FIGS. 1 and 3. The slotted holes **45*a* facilitate entry of seed and also some stems and other foreign matter that may not enter the holes 45**, especially when the casing is rotated much faster than the seed roll.

Figure 5:
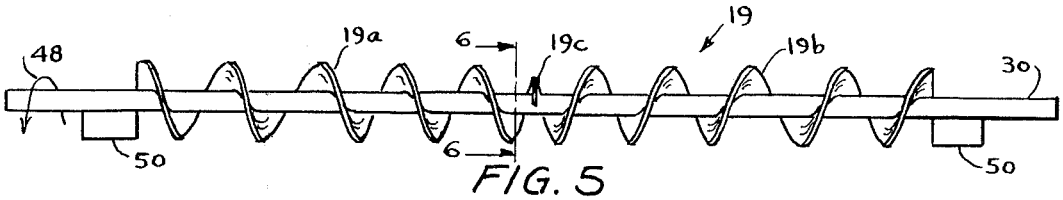
FIG. 5 is a front elevational view of the conveyor in FIG. 1 showing the right and left hand flights arranged to convey in both directions from center.

Although I show the rotation of conveyor 19 clockwise also, as indicated by arrow 48, it can be turned in the opposite direction if the spiral flights are of the opposite hand of that shown in FIGS. 1, 3, and 5. Unginned seed will not enter these holes so there is no lint lost. Otherwise, seed would be conveyed toward the center instead of out to the seed chutes. I prefer the rotation shown because of the interchangeability of parts which is fully explained in the specifications of modified embodiments of the invention.

To prevent cutting the seed as they enter the holes 45 and **45*a* I leave a space 44 of about $\frac{1}{4}''$ between the conveyor flights and the casing, as seen in FIG. 4. This prevents seed being trapped in the holes and sheared by the conveyor flights. Kicker blades 50 on shaft 30 prevent any blocking of the seed discharged by the conveyor. Visual inspection and access into both front and rear of the chutes is provided by glass covered doors 51 as required. As the seed are stripped of lint they gravitate toward the axial center and into casing 22 through holes 45 and 45*a* and conveyed laterally into the chutes 20**.

Figure 8:
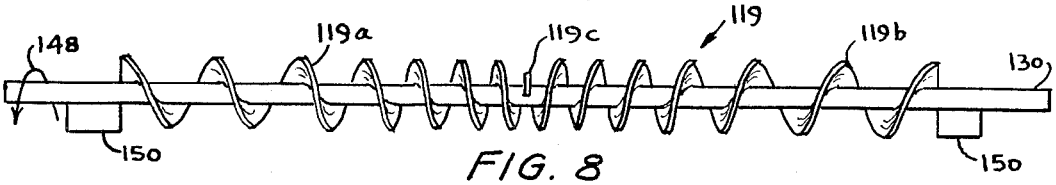
FIG. 8 is a front elevational view of a modified conveyor with both right and left hand flights of increasing lead from the center to the discharge ends.

Instead of conveyor 19 I may use conveyor 119 shown in FIG. 8. Conveyor 119 has right hand flight **119*a* and left hand flight 119*b* start at center 119*c* similar to conveyor 19 but instead of constant lead, the lead increases in regular increments from the center to the discharge. Thus the seed entering the casing move faster with each revolution of the conveyor thereby allowing more seed to enter progressively to insure an even discharge of seed over the full length of said roll and into said seed chutes. At a given speed, capacity increases with the lead. This insures an even flow of clean seed across the full length of the roll box into the casing. I find however that when the lead exceeds the conveyor diameter by $1\frac{1}{2}$ times there is some loss in efficiency due to excessive radial slip. When this occurs increasing conveyor speed usually makes the condition worse by moving more seed radially and thus impedes the entrance of additional seed through holes 45 and 45*a***.

Figure 9:
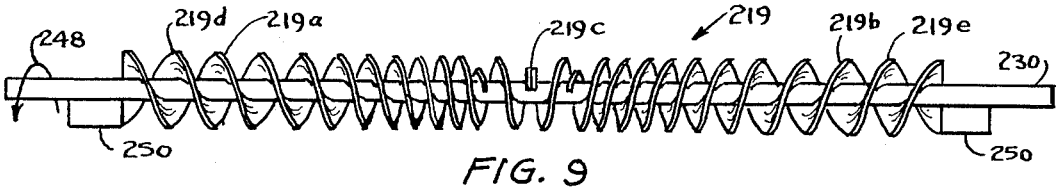
FIG. 9 is a front elevational view of a further modification of the conveyor in FIG. 8 to which intermediate flights are added for a substantial length of the discharge ends.
Figure 10:
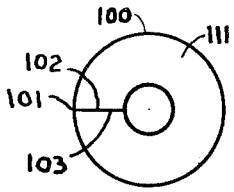
FIGS. 10, 11, 12 and 13 are end elevational views of the flat circular discs used to form the flight segments of increasing lead.
Figure 14:
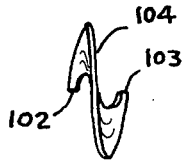
FIGS. 14, 15, 16 and 17 are front elevational views of the formed flight segments before assembly on the shaft.
Figure 11:
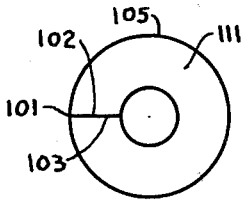

To insure efficient positive auxilliary seed discharge from for longer gins of 120 to 141 saws, I provide conveyor 219 also having flights of increasing lead similar to conveyor 119 but having intermediate flights **219*d* and 219*e* extending from the discharge ends back towords center 219*c* for a substantial length of the flights 219*d* and 219*e* as shown in FIG. 9. The intermediate flights double the conveying surface over the length required to convey the most seed and are more efficient even at lower speeds. Conveyors 119 and 219 have kickers 150 and 250 respectively and both are interchangeable with conveyor 19** for the same length gin. This permits the selection of the conveyor having the characteristics best suited to the particular cotton being ginned, which varies by species, area, climate and harvesting methods.

Figure 15:
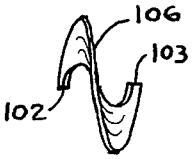
Figure 12:
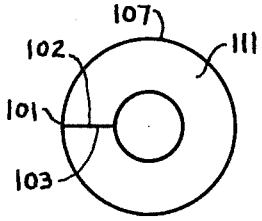
Figure 16:
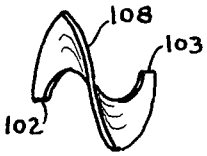
Figure 13:
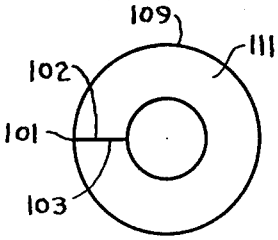
Figure 17:
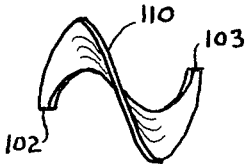

FIGS. 10 to 17 inclusive illustrate the method used to produce the special flights for conveyors 119 and 219. These conveyor flights are made from a plurality of spiral segments, each made from flat circular discs. Assuming the conveyor is to be 5" outside diameter on a 2 3/16" shaft, I start with the end to have the shortest lead, with a first disc 100 of 5 1/16" O. D. and a bore of 2¼" I. D. The rim 111 is sheared radially along line 101 so it has two free ends 102 and 103 which are then pulled axially apart until the bore fits snugly on the shaft and the O. D. is reduced to 5". This is now helical segment 104. The next requires disc 105 of 5⅛" O. D. and a 2 5/56" bore which is sheared and stretch formed in the same way to produce segment 106 as shown in FIG. 15. It is now 5" O. D. also but longer in lead than segment 104. This process is repeated as shown in FIGS. 12 to 17 inclusive to produce discs 107 and 109 and segments 108 and 110, each progressively longer in lead. The conveyor length will determine the number of segments required. Rim 111 remains constant in height at 1 13/32" for all segments and the conveyor 5" outside diameter for the entire length. This example is illustrative of the method only and it is obvious that the lead can be increased at a faster or slower rate by increasing or decreasing the difference in diameters and bores of successive discs.

To complete the conveyor, the helical segments are assembled on the shaft in progressive order as in FIGS. 8 and 9 by welding. Although the adjoining segment ends can be butt welded, I prefer lap welding because it is easier and makes a stronger joint. Those segments shown are all "right hand". For "left hand", the segment ends 102 and 103 are pulled apart in the opposite direction from that shown in FIGS. 16 to 19 inclusive. Intermediate flights **219*d* and 219*e* are made in the same manner as 119*a* and 119*b***.

Figure 18:
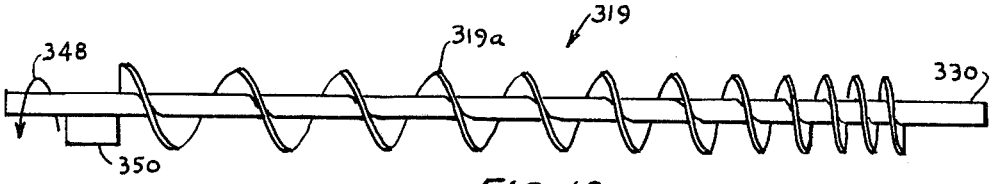
FIG. 18 is a front elevational view of a conveyor having all right hand flight of increasing lead to the discharge end.
Figure 19:
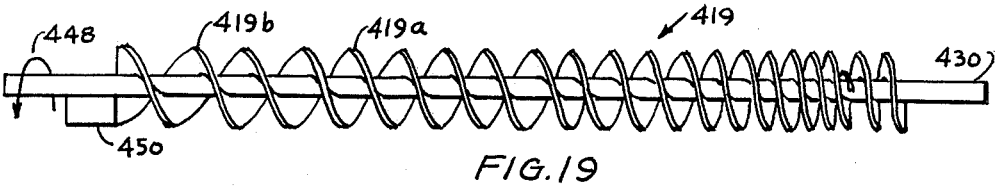
FIG. 19 is a front elevational view of the conveyor of FIG. 18 modified by adding intermediate flights for a substantial length of the discharge end.
Figure 20:
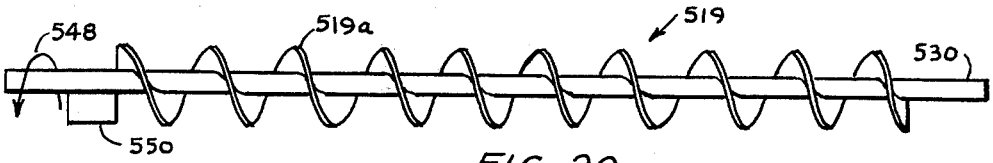
FIG. 20 is a front elevational view of a conveyor of all right hand flight of constant lead.

For installations requiring the auxilliary discharge at only one end of the gin (FIG. 21) I provide conveyors 319, 419 and 519 as shown in FIGS. 18, 19 and 20. They are illustrated as of all right hand flights. Conveyor 319 comprises flight **319*a* of increasing lead mounted on shaft 330 with kicker 350 at the discharge end. Conveyor 419 has both flights 419*a* and intermediate flight 419*b*, both of increasing lead on shaft 430 with kicker 450 at the discharge end. Conveyor 519 has flight 519*a* of constant lead mounted on shaft 530 with kicker 550 at discharge end. When rotated as indicated by arrows 348, 448 and 548 respectively at appropiate speed the seed are discharged out the left end of the gin as viewed in FIG. 21. For discharge out of the right end of the gin, the conveyors must be comprised of all left hand flights and the seed chutes 20 and associated parts must be assembled on the opposite end of the gin and casing 622 enclosing the conveyor must be turned end for end. Bearing support 93** and associated parts must be assembled on opposite end.

Figure 21:
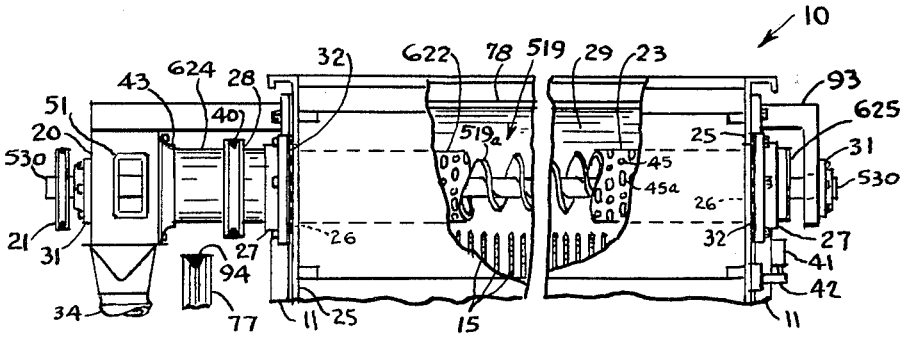
FIG. 21 is a fragmental front elevational view of gin modified to show the auxilliary seed discharge at only one end, the view being partly broken away and in section.
Figure 23:
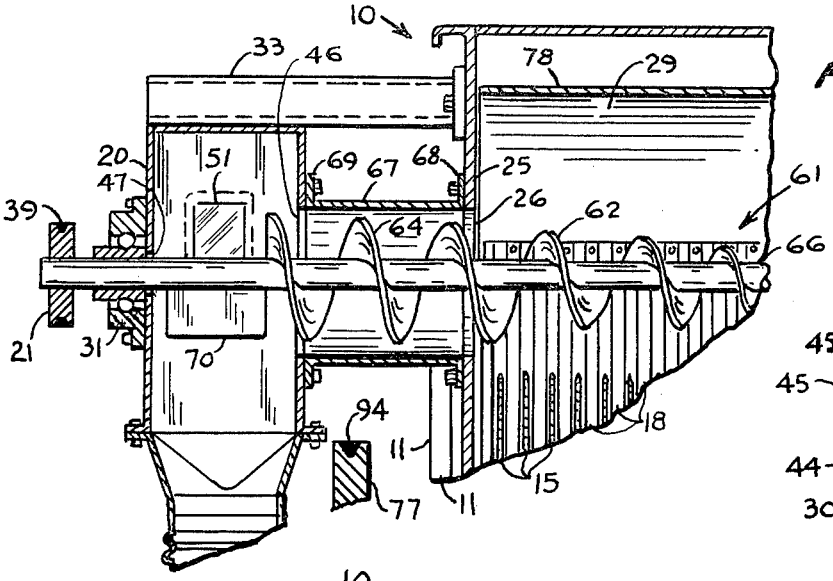
FIG. 23 is a fragmental elevational sectional detail view of the left end of the embodiment shown in FIG. 22.

Whenever conveyors 319, 419 or 519 are used they are enclosed in a rotatable perforate tubular casing 622 similar to casing 22 except that the right hand plain end as viewed in FIG. 21 extends only about 1" through bearing 27 and is partially closed with circular plate 625 affixed to the end of the casing. Plate 625 is provided with an axially aligned hole for the right end of shafts 330, 430 or 530 to project through and into bearing 31 on rigid support bracket 93 affixed to the right end breast head 25 as shown. The left hand end is provided with the same arrangement of parts as illustrated in FIGS. 1 and 3 and described in full detail as to construction and function.

While conveyors 319, 419 and 519 (single end discharge) can be used interchangeably with conveyors 19, 119 and 219 (double end discharge) in the same gin providing the above mentioned changes and substitutions are made, they are more efficient in gins under 6 feet long. The conveyors 19, 119 and 219 in the embodiment of FIG. 1 are preferred whenever space permits, especially in gins over 6 feet long.

As mentioned in the Abstract, I provide in this invention other modified embodiments especially adaptable to ginning roughly harvested cotton containing cotton plant stems, weeds, hulls, unopened bolls and other foreign matter as is common in areas that use sleds to strip the cotton. In spite of efforts to remove such matter in machinery ahead of the gins significant amounts reach the gin with the seed cotton. Such foreign matter cannot pass between the ribs or fall out of the roll box through the gravity seed discharge 14. Under these conditions the ginner resorts to "dumping" the roll frequently to rid the roll of this contaminative material. This reduces the capacity because every time the roll is dumped the seed roll must be built up again before normal ginning rate is regained. Neither wil this type material enter the holes 45 or **45*a* of the perforate casing 22, or 622** of the previously described embodiments. The solution to this problem is achieved in the following modifications of the auxilliary seed discharge conveyor.

Referring now to FIGS. 22 to 30 inclusive, I use the same gin frame 11, ginning breasts 12 and 13 including the openings 26 in roll box heads 25, and seed chutes 20 with support arms 33 without, change. Conversion to this embodiment is made by substituting parts as illustrated in these Figures: Instead of conveyors 19, 119 or 219 enclosed in a perforate casing, I use conveyor 61 (FIG. 27) having tapered right and left hand flight sections 62 and 63 with straight flight end sections 64 and 65 symetrically mounted on shaft 66. The small ends of these tapered flights start at at center 72 and their combined length equal the length of roll box 29 and the flights project into the seed roll. The straight sections 64 and 65 extend out through openings 26 into chutes 20. Shaft 66 is journaled in bearings 31 on the outside of the chutes. Plain cylindrical casings 67, having flanged ends 68 and 69 enclose the straight sections 64 and 65 between the heads 25 and chutes 20. The flanged ends have holes matching the bolt holes used for bearing 27 (previously used for casing 22) and the opposite end 69 has holes matching holes for seal 33 (also used for casing 22). Pulley 21 on shaft 66 drives conveyor 61 from power source 37 and belt 39, arranged the same as in FIG. 7. Limit switch 41 and bracket 43 are again used as before in the control circuit for power source 37. Kickers 70 on shaft 66 have the same function as kickers 50.

When conveyor 61 is rotated as indicated by arrow 71, at appropiate speed seed and commingled foreign matter are conveyed laterally in both directions out of the core of the seed roll through holes 26, and on through casings 67 in chutes 20. Since the conveyor rotation is the same as the seed roll it helps the saws in turning the roll when driven at, or above the roll speed.

Figure 27:
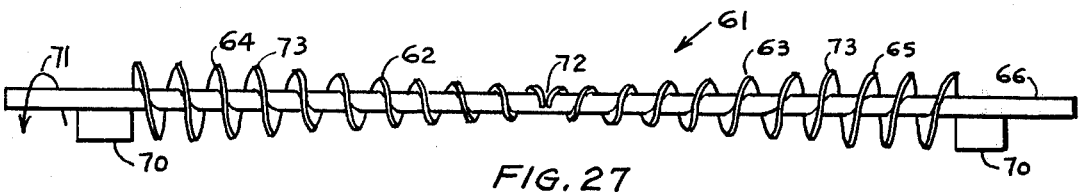
FIG. 27 is a front elevational view of a conveyor having tapered right and left hand flights on the central section and straight flight sections on each end.

To insure removing seed and foreign matter in even amounts over the full length of the roll I provide a double-tapered coveyor 61 having constantly increasing capacity from the center 72 to the end sections 64 and 65. The capacity of helical conveyors depends on speed, lead and height of flight. Since there is no perforate casing in the embodiments of FIGS. 22, 23 or 24 I found it necessary to increase the height of the flight symetrically at a constant angle from the lowest point 73 at center 72 to the highest point at the outer ends of the roll box as shown in FIG. 27. As the clean seed and foreign matter gravitate toward the axial core of the roll they enter the space between the flights to the shaft 66. When first starting to gin, or when building a new roll after dumping one, it is important that the conveyor be driven no faster than the roll itself until the flights are filled with clean seed and foreign matter but no seed having lint still attached. Because there is no relative movement between the flights and the roll when they rotate at the same speed, there is no lateral thrust by the conveyor flights. After the lint is ginned from enough seed the flights are filled with lint free seed and some of the clean seed begin to fall out the gravity discharge as the roll "breaks" on the downturn against front wall 79 of the roll box. The conveyor speed is then increased to provide sufficient relative movement between flights and seed so the clean seed within the flights are moved bilaterally out of the roll box and into chutes 20. The seed that fill the flights near the core retain their position close to the shaft and additional layers of clean seed are entrained as the height of the flight increases towards the discharge end. This insures an even discharge of seed from the full length of the roll. Appropiate conveyor speed can best be determined by the ginner. Visual inspection of the seed discharged by the conveyor is easily made through glass covered doors 51 in chutes 20. If speed is too fast there will be some loss of seed with some lint or "tails" still attached. If too slow, the density of the roll will increase and cause the associated feeders to automatically reduce the flow of seed cotton into the gin breast, thus reducing the potential capacity. The ideal speed is somewhere in between as the ginner will quickly learn. Modern gins have automatically controlled feeders that maintain a predermined roll density in response to variations directly, or in the current to the motor driving the gin. These changes are directly proportional to the amount of seed cotton entering the roll box and the amount of seed and other matter discharged from the roll box.

Figure 28:
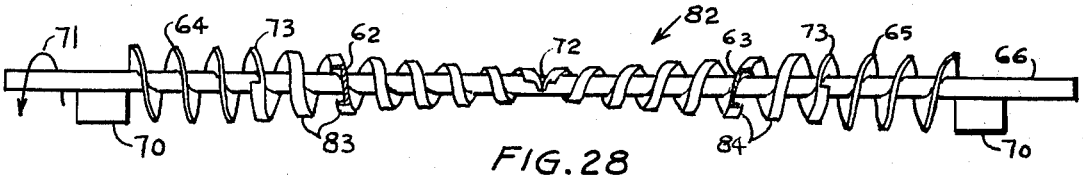
FIG. 28 is a front elevational view of a modification of the conveyor of FIG. 27, the modification being the addition of flanges on the peripheral leading edges of the tapered flight sections, the view being partly broken away and in section.

As another embodiment, instead of conveyor 61 I may use conveyor 82, also double-tapered, but having flanges 83 and 84 on the peripheral leading edges of the tapered flights as shown in FIG. 28. These flanges help increase capacity at higher speeds by reducing radial slip of seed and foreign matter off the flights. Flanges can be about 1¼" wide and welded to the flights for substantially the length of the roll box. Other than the flanges, conveyor 82 is the same as conveyor 61 and interchangeable with it. Neither is used with the rotatable perforate casing and the tapered flights project directly into the surrounding seed roll. This insures filling the flights with clean seed and foreign matter of such nature that would not enter the holes in the perforated casing if it were used for. For this reason conveyors 61 and 82 are particularly suited for use with roughly harvested cotton.

Figure 24:
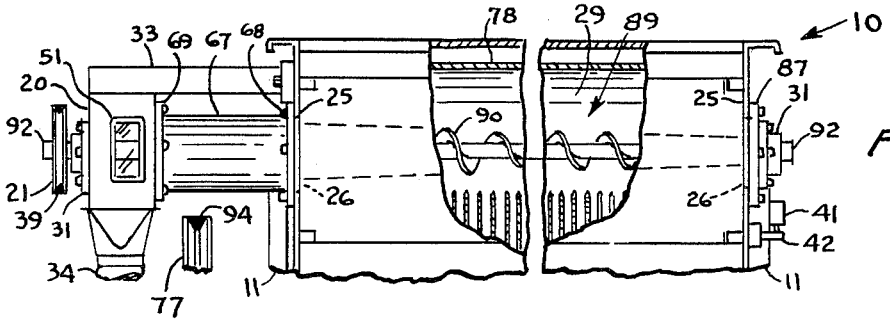
FIG. 24 is a fragmental front elevational view of a modification of the embodiment of FIG. 22 showing the discharge at one end, the view being partly broken away and in section.
Figure 29:
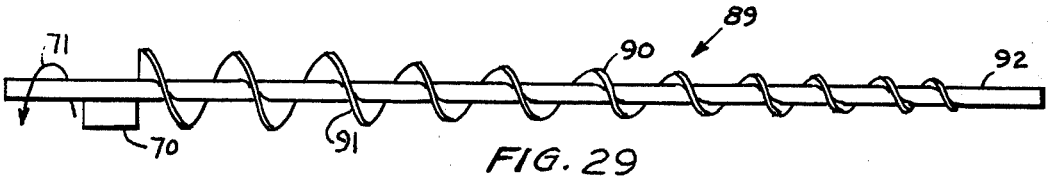
FIG. 29 is a front elevational view of the conveyor in FIG. 24 having tapered right hand flight to discharge at only one end and having a straight section of flight on the discharge end.
Figure 30:
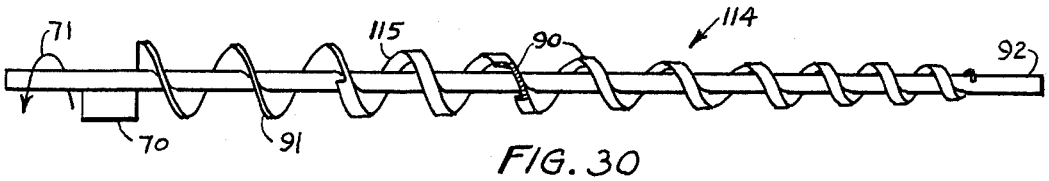
FIG. 30 is a modification of the conveyor of FIG. 29 in which flanges are added on the peripheral leading edges of the tapered flight.

For installations ginning rough cotton requiring single end discharge I provide still another embodiment using a tapered conveyor 89 having constantly tapered flight 90 substantially the length of the roll box and straight flight 91 from roll box 29 to chute 20 through plain casing 67 as shown in FIGS. 24 & 29. Shaft 92 extends through opening 88 in plate 87 mounted on the right end of the roll box and into bearing 31. The left, or, discharge end of the conveyor shaft extends through chute 20 into bearing 31 on the outside of chute 20 supported by arm 33 from head 25 as before. Pulley 21 on shaft 92 is driven by power source 37 and belt 39 at selective speeds. Limit swich 41 and bracket 42 are mounted and used as before. Operation is the same as that given for the embodiment of FIG. 23.

Again, instead of using a plain tapered conveyor, I may use conveyor 114 (FIG. 30) having flange 115 On the peripheral leading edges of the tapered flight 90 for the same purpose explained for the embodiment of FIG. 28. Conveyor 114 is journaled and driven in the same manner shown and described for the embodiment of FIG. 24. I also use the same limit switch as set forth for that embodiment. When the breast is opened belt 39 becomes slack so that conveyor 114 stops and switch 41 opens the control circuit for power source 37 as previously described for added safety.

Where both embodiments of FIGS. 21 and 24 show the auxilliary discharge at the left end, the only change in parts required for right hand discharge is that the conveyor flights must be of the opposite hand so they can be rotated in the same direction as the seed roll. The other associated parts are simply assembled on opposite ends to that shown in FIGS. 21 and 24. This includes the drive to the conveyor shaft shown in FIG. 7.

While I have shown several embodiments of my invention it is understood that the invention may be otherwise embodied and used within the scope of the following claims.

What I claim is:

1. Auxilliary seed discharge means for a saw type cotton gin comprising in combination:

A. a main frame having a rotating saw cylinder journaled therein,

B. a ginning breast and a huller breast movably mounted on said frame from closed to open positions, C. a roll box in said ginning breast to receive seed cotton introduced through said huller breast, D. spaced gin saws on said saw cylinder projecting through the roll box and arranged to pull seed cotton from the huller breast into the roll box to form a rotating seed roll and to separate lint from seed therein.

E. a gravity seed discharge from said roll box,

F. circular openings in the end heads of the roll box in the approximate axial center thereof, G. a seed chute rigidly supported from one of said end heads and having circular openings in axial alignment with the openings in said roll box heads, H. a cylinderical casing connected in axial alignment between the said openings in the chute and the adjacent roll box, I. a plate mounted over the circular opening in the opposite end head, said plate hving a central circular opening in axial alignment with said openings in said heads, J. a rotatable shaft extending axially through the roll box and outwardly through said casing and said opposite end head into bearings affixed on the outside of said chute and plate, K. a section of constantly tapered helicoid flight the length of said roll box mounted on said shaft and projecting into the core of said seed roll to convey even amounts of seed laterally from the full length thereof when rotated in the same direction and at speeds greater than that of said seed roll.

L. a straight section of conveyor flight joining the large end of said tapered flight and extending through said casing into said seed chute, M. a pulley on said shaft independently driven from a power source forward of said shaft, said power source being adapted to drive the shaft at selective speeds.

2. The combination of claim 1 in which the said tapered flight is provided with a flange on the peripheral leading edges to reduce the radial slip of the seed and foreign matter off the flights when driven at substantially higher speeds than said seed roll.

3. Auxilliary seed discharge means for a saw type cotton gin comprising in combination:

A. a main frame having a rotating saw cylinder journaled therein,

B. a ginning breast and a huller breast movably mounted on said frame from closed to open positions, C. a roll box in said ginning breast to receive seed cotton introduced through said huller breast, D. spaced gin saws on said saw cylinder projecting through the roll box and arranged to pull seed cotton from the huller breast into the roll box to form a rotating seed roll and to separate lint from seed therein, E. a gravity seed discharge from said roll box, F. circular openings in the end heads of the roll box in the approximate axial center thereof.

G. seed chutes rigidly supported from each of said end heads of said breast and having circular openings in axial alignment with the openings in said roll box heads, H. cylindrical casings connected in axial alignment between said openings in the chutes and the adjacent roll box heads, I. a rotatable shaft extending axially through the roll box and outwardly through said casings and into bearings affixed on the outside of said chutes, J. two sections of constantly tapered helicoid conveyor flights of opposite hand symetrically mounted on said shaft with lowest heights at center and extending to the outer ends of said roll box with said flights projecting into the core of said seed roll to convey even amounts of seed bilaterally from the full length thereof when rotated in the same direction and at speeds greater than that of said seed roll.

K. straight conveyor flight sections joining the large ends of said tapered sections and extending through said casings into said seed chutes, L. a pulley fixed on one end of said shaft independently driven from a power source forward of said shaft, said power source being adapted to drive the shaft at selective speeds.

4. The combination of claim 3 in which rotation of said conveyor ceases when the ginning breast is opened and resumes when the breast is closed, when said power source is running.

5. The combination of claim 3 in which the said power source is an electric motor.

6. The combination of claim 5 in which a limit switch is mounted on said frame and disposed to open the control circuit to said motor when the ginning breast is opened and to close said circuit when the breast is closed.

7. The combination of claim 3 in which flexible conduits connect from said seed chutes to the main seed conveyor.

8. The combination of claim 3 in which inspection doors are provided in said seed chutes.

9. The combination of claim 3 in which the conveyor shaft has has kickers adjacent the discharge ends of the flights.

10. The combination of claim 3 in which said tapered flights are provided with flanges on the peripheral leading edges to reduce the radial slip of the seed and foreign matter off the flights when the conveyor is driven at substantially higher speeds than the seed roll speed.

11. Auxilliary seed discharge means for a saw type cotton gin comprising in combination:

A. a main frame having a rotating saw cylinder journaled therein,

B. a ginning breast and a huller breast movably mounted on said frame from closed to open positions, C. a roll box in said ginning breast to receive seed cotton introduced through said huller breast, D. spaced gin saws on said saw cylinder projecting through the roll box and arranged to pull seed cotton from said huller breast into said roll box to form a rotating seed roll and to separate lint from the seed therein, E. a gravity seed discharge from said roll box, F. circular openings in the end heads of said roll box in the approximate axial center thereof, G. a tubular casing extending axially through said openings and rotatably journaled in bearings outside said roll box heads, H. said casing comprising a perforate section the length of said roll box with about 7/16 inch round holes alternating with about 7/16 by ¾ inch circumferential slots in spaced longitudinal and circumferential rows to allow entry of clean seed and some foreign matter but rejecting unginned seed locks and having one short plain end section partially closed by a plate and a longer opposite plain section with open end for discharge of said clean seed and foreign matter therefrom, I. a pulley on one of said plain ends driven independently at selective speeds in the same direction as the seed roll from a power source forward of said casing, J. a seed chute rigidly supported from one end of said breast and having circular openings in axial alignment with the openings in said roll box heads and disposed to admit said open casing end through one of said openings.

K. a rigid bearing support bracket affixed to the opposite end head of said breast and having a circular opening in axial alignment with said openings in said roll box heads, L. a rotatable shaft extending axially through said casing and outwardly thereof and into journal bearings mounted on the outside of said seed chute and said support bracket, M. helicoid conveyor flight mounted on said shaft spaced from said casing about ¼ inch to prevent cutting the clean seed entering through said holes disposed to convey the seed and foreign matter laterally outward through said open end and into said seed chute when rotated at appropriate speed, N. a pully mounted on one end of said shaft and driven at selective speeds from an independent source forward of said shaft.

12. Auxilliary seed discharge means for a saw type cotton gin comprising in combination:

A. a main frame having a rotating saw cylinder journaled therein,

B. a ginning breast and a huller breast movably mounted on said frame from closed to open positions, C. a roll box in said ginning breast to receive seed cotton introduced through said huller breast, D. spaced gin saws on said saw cylinder projecting through the roll box and arranged to pull seed cotton from said huller breast into said roll box to form a rotating seed roll and to separate lint from seed therein, E. a gravity seed discharge from said roll box, F. circular opennings in the end heads of said roll box in the approximate axial center thereof, G. a tubular casing extending axially through said openings and rotatably journaled in bearings outside said roll box heads, H. said casing comprising a perforate section the length of said roll box with about 7/16 inch round holes in spaced longitudinal and circumferential rows to allow entry of clean seed and some foreign matter but rejecting unginned seed locks and having plain end sections extending outwardly of the roll box sufficiently for the discharge of said seed and foreign matter beyond the integral drives on the gin proper, I. a pulley on one of plain sections driven independently at selective speeds in the same direction as the seed roll from a power source forward of said casing, J. seed chutes rigidly supported from each end of said breast and having circular openings in axial alignment with the openings in said roll box heads and disposed to admit the ends of said plain casing sections through one of said openings in each chute, K. a rotatable shaft extending axially through said casing and outwardly thereof into journal bearings mounted on the outside of said seed chutes, L. two sections of helicoid conveyor flight of opposite hand mounted on said shaft and spaced from said casing about ¼ inch to prevent cutting the clean seed entering through said holes disposed to convey the seed and foreign matter bilaterally outwardly from center and into said chutes when rotated at appropriate speed, M. a pulley mounted on one end of said shaft and driven at selective speeds from an independent power source forward of said shaft.

13. The combination of claim 12 in which rotation of said casing and said conveyor ceases when the ginning breast is opened and resumes when the breast is closed, when said power source is running.

14. The combination of claim 12 in which flexible conduits connect from said seed chutes to the main seed conveyor.

15. The combination of claim 12 in which inspection doors are provided in said seed chutes.

16. The combination of claim 12 in the conveyor shaft has a kicker adjacent the discharge end of the flights.

17. The combination of claim 12 in which seal means are provided around said casing between the roll box heads and the bearings and at the entrance to the seed chutes.

18. The combination of claim 12 in which the conveyor flights are faired in tangent to the shaft where they meet at the center of the roll box.

19. Auxilliary seed discharge means for a saw type cotton gin comprising in combination:

A. a main frame having a rotating saw cylinder journaled therein,

B. a ginning breast movably mounted on said frame disposed to be moved from active (closed) ginning position to inactive (open) position and from inactive to active position, C. a huller breast attached to said ginning breast and movable therewith, D. a seed cotton entry in said huller breast, E. a roll box in said ginning breast disposed to receive the seed cotton from said huller breast, F. spaced gin saws on said saw cylinder projecting through said roll box effective to pull seed cotton from the huller breast into the roll box to form a rotating seed roll and to remove the lint while leaving the clean seed therein, when said breasts are in the active (closed) ginning position, G. a gravity seed discharge from said roll box through which a portion of the clean seed fall out of said roll, H. circular openings in the end heads of said roll box in axial alignment with the rotational center of said roll, I. rotatable auxilliary seed discharge helical conveyor means running longitudinally through said roll box extending outward through said openings effective to discharge a portion of the clean seed laterally out of the roll box when rotated at appropriate speeds in the same direction as said seed roll, J. bearing means supported on said end heads journaling said auxilliary seed discharge means in axial alignment with said circular openings, K. independent power means drivingly connected to said auxilliary seed discharge means located in a forward position thereof effective to rotate said discharge means at selective speeds when said breasts are in the active (closed) position and to stop rotation when breasts are in inactive (open) position.

20. The combination of claim 19 in which the clean seed entering said auxilliary discharge means are conveyed into sealed chute means comprising a part of said bearing support means having glass covered inspection doors and flexible conduit connecting to the main seed conveyor beneath the gin(s) to prevent the escape of seed and dust.

21. Auxiliary seed discharge means for a saw type cotton gin comprising in combination:

A. a main frame having a rotating saw cylinder journaled therein,

B. a ginning breast and a huller breast movably mounted on said frame from closed to open positions, C. a roll box in said ginning breast to receive seed cotton introduced through said huller breast, D. spaced gin saws on said saw cylinder projecting through the roll box and arranged to pull seed cotton from the huller breast into the roll box to form a rotating seed roll and to separate lint from the seed therein, E. a gravity seed discharge from said roll box, F. circular openings in the end heads of the roll box in the approximate axial center thereof, G. a tubular casing extending axially through said openings and rotatably journaled in bearings outside the roll box heads, H. said casing comprising a perforate section the length of the roll box with rows of circumferentially slotted holes of about 7/16 inch by ¾ inch alternating with round holes about 7/16 inch diameter in each of the longitudinal and circumferential rows to allow entry of clean seed and some foreign matter therethrough into the casing but rejecting unginned seed locks and having one short plain end section partially closed and a longer opposite plain section with open end for discharge of the seed and foreign matter therefrom, I. a pulley on one of the plain ends driven independently and externally of said roll box at selective speeds in the same direction as the seed roll from a power source forward of said casing, J. a seed chute rigidly supported from one end of said breast having circular openings axially aligned with the openings in the roll box disposed to admit the open casing end through one of said openings to receive the seed and foreign matter discharged therefrom, K. rigid bearing support bracket affixed to the opposite head of the breast having a circular opening axially aligned with the openings in the roll box, L. a rotable shaft extending axially through said casing and outwardly thereof and into bearings mounted on the outside of said seed chute and support bracket, M. helicoid conveyor flight of progressively increasing lead toward the discharge end mounted on said shaft with the outer edges of the flight spaced inwardly of the casing about ¼ inch to prevent cutting the seed entering through said holes disposed to convey the seed and foreign matter laterally at accelerating speed with each revolution thus allowing an even flow of clean seed into the casing across the full length of the roll box and into the seed chute, N. a pulley mounted on one end of said shaft and driven at selective speeds from an independent power source forward of said shaft.

22. The combination of claim 21 wherein intermediate helicoid flight of conforming configuration is provided over a substantial length of the discharge end of the shaft whereby the conveying surface is approximately doubled over the length required to convey the most seed.

23. The combination of claim 21 wherein said conveyor flight of progressively increasing lead comprises a plurality of spiral segments formed from flat discs of constantly increasing diameters and bores but of the same rim height assembled on the shaft and joined together in regular increments.

24. Auxiliary seed discharge means for a saw type cotton gin comprising in combination:

A. a main frame having a rotating saw cylinder journaled therein,

B. a ginning breast and a huller breast movably mounted on said frame from closed to open positions, C. a roll box in said ginning breast to receive seed cotton introduced through the huller breast, D. spaced gin saws on said saw cylinder projecting through the roll box and arranged to pull seed cotton from the huller breast into the roll box to form a rotating seed roll and to separate lint from seed therein, E. a gravity seed discharge from said roll box, F. circular openings in the end heads of the roll box in the approximate axial center thereof, G. a tubular casing extending axially through said openings and rotatably journaled in bearings outside the roll box heads, H. said casing comprising a perforate section the length of the roll box with rows of round holes about 7/16 inch diameter in each of the longitudinal and circumferential rows to allow entry of clean seed and some foreign matter therethrough into the casing but rejecting unginned seed locks and having plain end sections extending outwardly of said roll box sufficiently for the discharge of said seed and foreign matter beyond the integral drives on the gin proper, I. a pulley on one of said plain end sections driven independently at selective speeds in the same direction as the seed roll from a power source forward of said casing, J. seed chutes rigidly supported from each end of said breast and having circular openings in axial alignment with the openings in the roll box heads and disposed to admit the ends of said plain casing sections through one of said openings in each chute, K. a rotatable shaft extending axially through said casing and outwardly thereof into journal bearings mounted on the outside of said seed chutes, L. two sections of helicoid conveyor flight of opposite hand and of progressively increasing lead toward the discharge ends mounted on said shaft with outer edges of the flights spaced inwardly of the casing about ¼ inch to prevent cutting the seed entering through said holes disposed to convey the seed and foreign matter bilaterally at accelerating speed with each revolution thus allowing an even flow of clean seed into the casing across the full length of the roll box and into the seed chutes, M. a pulley mounted on one end of said shaft and driven at selective speeds from an independent power source forward of said shaft.

25. The combination of claim 24 wherein intermediate helicoid flights of conforming configuration are provided over a substantial length of the discharge ends of the shaft whereby the conveying surfaces are approximately doubled over the lengths required to convey the most seed.

26. The process of positively discharging a portion of the commingled material composed of clean ginned seed and foreign matter laterally from the core of the seed roll along the longitudinal axis thereof concurrently with the conventional gravity discharge of other clean seed from the seed roll, which comprises driving a helicoid conveyor, having tapered flights projecting into the seed roll, in the same direction and at a speed no faster than the surrounding mass of seed cotton during the building of the seed roll until the conveyor flights are filled with such commingled material, and other clean seed begin falling out through the gravity discharge as the roll breaks on the downturn, then increasing the speed of the conveyor appropriately to provide sufficient relative movement between the flights and the commingled material therebetween to convey said material laterally out of the roll box.

* * * * *

UNITED STATES PATENT AND TRADEMARK OFFICE

CERTIFICATE OF CORRECTION

PATENT NO. : 4,313,242

DATED : February 2, 1982

INVENTOR(S) : Joe E. Salmon

It is certified that error appears in the above—identified patent and that said Letters Patent is hereby corrected as shown below:

On The Title Page, Abstract, line 7, "adequately" should read -- independently driven --.

Column 7, line 10, "2 5/56//" should read -- 2 5/16//

Signed and Sealed this

Twentieth Day of July 1982

[SEAL]

Attest:

GERALD J. MOSSINGHOFF

Attesting Officer

Commissioner of Patents and Trademarks